US008828894B2

(12) United States Patent
Newton

(10) Patent No.: US 8,828,894 B2
(45) Date of Patent: Sep. 9, 2014

(54) REINFORCEMENT MESH FOR ARCHITECTURAL FOAM MOULDING

(75) Inventor: Mark Joseph Newton, Perkinsfield (CA)

(73) Assignee: Saint-Gobain ADFORS Canada, Ltd., Grand Island, NY (US)

( * ) Notice: Subject to any disclaimer, the term of this patent is extended or adjusted under 35 U.S.C. 154(b) by 849 days.

(21) Appl. No.: 11/759,540

(22) Filed: Jun. 7, 2007

(65) Prior Publication Data

US 2008/0302055 A1 Dec. 11, 2008

(51) Int. Cl.

| | |
|---|---|
| ***E04B 9/00*** | (2006.01) |
| ***E06B 3/30*** | (2006.01) |
| ***B32B 5/02*** | (2006.01) |
| ***B32B 27/02*** | (2006.01) |
| ***D03D 15/00*** | (2006.01) |
| ***B32B 5/08*** | (2006.01) |
| ***B32B 5/16*** | (2006.01) |
| ***B32B 1/04*** | (2006.01) |
| ***B32B 13/14*** | (2006.01) |
| *E04F 19/04* | (2006.01) |

(52) U.S. Cl.

CPC ..... *E04F 19/04* (2013.01); *E04F 2019/0431* (2013.01)

USPC ..... 442/208; 52/204.53; 52/450; 52/454; 442/43; 442/44; 442/45; 442/46; 442/209; 442/210; 442/212; 442/213; 442/218; 442/219; 442/220; 442/227; 428/70; 428/71

(58) Field of Classification Search

CPC ..... E04F 13/04–13/047; E04F 11/187; E04F 13/06–13/068; E04F 19/00–19/0495; E04F 2013/00–2013/63; E04F 2203/00–2203/08; E04C 5/00–5/07; D03D 1/00; D03D 19/00; D03D 15/0011; C09J 2400/263; C09J 2400/266; B29C 70/06; B29C 70/22; B29C 70/224; B32B 13/00; B32B 13/04

USPC ..... 442/17, 30, 183, 208, 203, 226, 221; 428/36.5, 71, 158; 52/450–454, 52/660–676, 204.53

See application file for complete search history.

(56) References Cited

U.S. PATENT DOCUMENTS

| | | | | |
|---|---|---|---|---|
| 3,391,037 | A | | 7/1968 | McNulty |
| 4,434,512 | A | | 3/1984 | Hansen |
| 4,712,366 | A | | 12/1987 | Tsujimoto et al. |
| 5,442,886 | A | * | 8/1995 | Iacobelli ..... 52/255 |
| 5,552,207 | A | | 9/1996 | Porter et al. |
| 5,753,351 | A | | 5/1998 | Yoshida et al. |
| 5,763,043 | A | * | 6/1998 | Porter et al. ..... 428/109 |
| 5,843,542 | A | * | 12/1998 | Brushafer et al. ..... 428/36.1 |

(Continued)

OTHER PUBLICATIONS

Mesh, Warp, Weft/Filling and yarn definitions in Textile Glossary, copyright 2001, Celanese Acetate (cited in 12/606,362 Final Office Action Feb. 29, 2012).

(Continued)

*Primary Examiner* — Jennifer A Steele

(74) *Attorney, Agent, or Firm* — Abel Law Group, LLP; Robert N. Young

(57) ABSTRACT

A reinforcement mesh, an architectural moulding reinforced by the mesh, and methods of making the architectural moulding and the mesh. The mesh is adhered by an adhesive to the architectural moulding. In the mesh, weft yarns bend relative to warp yarns to conform to and against a curved profile of the architectural moulding, and the warp yarns are unbent and adhered against the moulding.

23 Claims, 5 Drawing Sheets

(56) References Cited

U.S. PATENT DOCUMENTS

| | | | | |
|---|---|---|---|---|
| 5,987,835 | A * | 11/1999 | Santarossa | 52/417 |
| 6,584,749 | B2 | 7/2003 | Sperber | |
| 6,729,090 | B2 | 5/2004 | Messenger et al. | |
| 6,799,403 | B2 | 10/2004 | Winter | |
| 6,848,228 | B1 | 2/2005 | Williams | |
| 6,926,055 | B1 | 8/2005 | Colson et al. | |
| 6,927,183 | B1 | 8/2005 | Christen | |
| 6,935,081 | B2 | 8/2005 | Dunn et al. | |
| 6,964,809 | B2 | 11/2005 | Hojaji et al. | |
| 7,045,474 | B2 | 5/2006 | Cooper et al. | |
| 7,048,708 | B2 | 5/2006 | Evans et al. | |
| 7,100,336 | B2 | 9/2006 | Messenger et al. | |
| 7,121,051 | B2 | 10/2006 | Hunsaker | |
| 7,147,197 | B2 | 12/2006 | Dalton | |
| 7,435,694 | B2 | 10/2008 | Kajander | |
| 2001/0050045 | A1* | 12/2001 | Rao et al. | 118/410 |
| 2005/0009428 | A1 | 1/2005 | Porter et al. | |
| 2005/0144901 | A1* | 7/2005 | Egan et al. | 52/782.1 |
| 2005/0242463 | A1* | 11/2005 | Schmidt | 264/171.13 |

OTHER PUBLICATIONS

Leno Weave, Textile Glossary, copyright 2001, Celanese Acetate LLC.

* cited by examiner

REINFORCEMENT MESH FOR ARCHITECTURAL FOAM MOULDING

FIELD OF THE INVENTION

The present invention relates to a reinforcement mesh to bend and conform to a profile of curved architectural features on an architectural moulding, and to an architectural moulding reinforced by the mesh.

BACKGROUND

Fiber glass mats are used as a facing material to reinforce flat insulation panels of polyurethane foam. However the glass mats or mesh have never been engineered to comply with the needs of the industry to reinforce curved profiles of architectural mouldings.

An architectural moulding comprises a decorative strip that has the appearance of being made of solid plaster or solid cement when installed on a building. The moulding comprises a light weight polymeric foam core having a surface topography shaped with decorative, curved architectural features to provide a decorative appearance, and a surface layer of cementitious material to provide an exterior finish coating over the curved architectural features. For example, the finish coating comprises plaster for indoor use or Portland cement for outdoor use.

Moreover, as new architectural profiles are designed and built, existing mesh products have been unable to adapt to a new profile, such that the mesh will tend to lift away from the surface of the profile, particularly at an abrupt radius of curvature or at a series of reversing radii of curvature. Manufacturers deal with this problem by delaying or interrupting the process of applying the cementitious coating and relying on hand work to press down the uplifted mesh, or by applying a localized amount of adhesive to re-attach the mesh against the profile and waiting for the adhesive to cure to a tenacious adherent state. What results is a delay in manufacturing, as well as, the increased probability of producing a defective part in which the mesh is insufficiently attached to the profile, or may even protrude out from the cementitious coating.

An architectural moulding has a light weight foam core, typically an expanded high density polystyrene, in the form of an elongated beam of substantial length, eight feet or two meters, for example, and of substantially large aspect ratio of length versus transverse dimensions. The cross sectional dimensions are thin relative to the length. Thus, the architectural moulding is vulnerable to sagging, by beam deflection, under the influence of its own weight and length when transported and handled prior to installation on a building. Sagging applies stress that tends to crack the ceinentitious coating when placed under tension. Sagging further applies stress that tends to separate the cementitious coating from the foam core. Ambient temperature changes further contribute to such cracking and/or separation due to a difference in thermal expansion rates of the foam core and the cementitious coating. Thus, to restrain sagging and undue thermal expansion and contraction of the foam core relative to the cementitious coating, a reinforcement mesh is applied to the foam core before the cementitious coating is applied. This requires bending of the mesh to conform to and against the decorative, curved profile of the architectural features on the foam core.

The mesh carries an adhesive on one side of the mesh to adhere the mesh to the profile. However, the mesh when bent tends to undergo elastic strain, which stores resilient spring energy in the bent yarns of the mesh. The stored spring energy thereby provides an impetus to the bent mesh to return to its former unbent orientation, a behavior referred to as undergoing shape memory recovery. The elastic strain and tendency for shape memory recovery lifts the mesh away from the profile of the polystyrene core, and spring biases the adhesive to give way under tension and release the mesh from adherence to the profile. Moreover, a mesh complying with an industry standard specification for minimum areal weight tended to undergo significant strain and shape memory recovery, which lifted the mesh from the surface of the architectural moulding core.

Over the mesh is applied a coating of a proprietary plaster, concrete, or other cementitious material to a thickness of about 0.13 inches, 3.3 mm., which bonds to the mesh and penetrates through openings through the mesh to bond with the foam core. Given the weight and brittle nature of the cementitious coating, the softness of the polystyrene core and the beam length and large aspect ratio of the moulding, it is easy to foresee that its own weight and length would induce a bending moment capable of cracking the coating. Moreover, given the length of the moulding and its construction of dissimilar materials, it is understandable that cracking of the cementitious material would occur due to differences in thermal expansion rates of the dissimilar materials. The reinforcement mesh serves to resist the beam deflection and bear the thermal expansion loads. However, prior to the invention, the reinforcement mesh was prone to lifting away from the polystyrene core due to a tendency for shape memory recovery.

What the moulding industry requires in terms of mesh behaviors are, for the mesh to bend and conform to and against a profile of curved architectural features on an architectural moulding, and for the mesh to remain substantially where it was placed and remain adhered to the profile over the passage of time, at least until the cementitious coating is applied and dried to a stable rigid state. Further, compliance of a mesh with an industry accepted standard for a minimum areal weight is desirable.

SUMMARY OF THE INVENTION

The invention pertains to a reinforcement mesh having weft yarns that bend and conform to and against a curved profile of curved architectural features on an architectural moulding. The weft yarns bend relative to the relatively straight warp yarns of the mesh. The weft yarns bend with limited elastic strain. The reinforcement mesh has relatively straight and substantially stiff warp yarns to extend longitudinally straight along the length, and against the architectural moulding. Advantageously, the substantially straight warp yarns resist beam deflection and restrain differential thermal expansion while the weft yarns bend and conform to and against the curved profile of the moulding with limited elastic strain.

Further, the invention relates to a method of making the reinforcement mesh. Further, the invention relates to an architectural moulding having the reinforcement mesh. Further the invention relates to a method of making the architectural moulding.

A mesh of engineering design is specifically aimed at solving the problem wherein the yarns of prior known mesh tend to lift away from a curved profile of architectural features on an architectural moulding. The invention complies with the requirements of end use, to resist beam deflection of the moulding, to restrain undue thermal expansion and contraction and to retain the mesh attached to a foam core of the moulding for an adequate time period during a manufacturing process until a cementitious coating is applied and cured to a stable solidified state. The usual time period comprises seven days for the cementitious coating to cure to a stable solidified state. The cementitious coating may continue to cure after attaining a stable solidified state.

BRIEF DESCRIPTION OF THE DRAWINGS

Embodiments of the invention will now be described by way of example with reference to the drawings.

DETAILED DESCRIPTION

Figure 1:
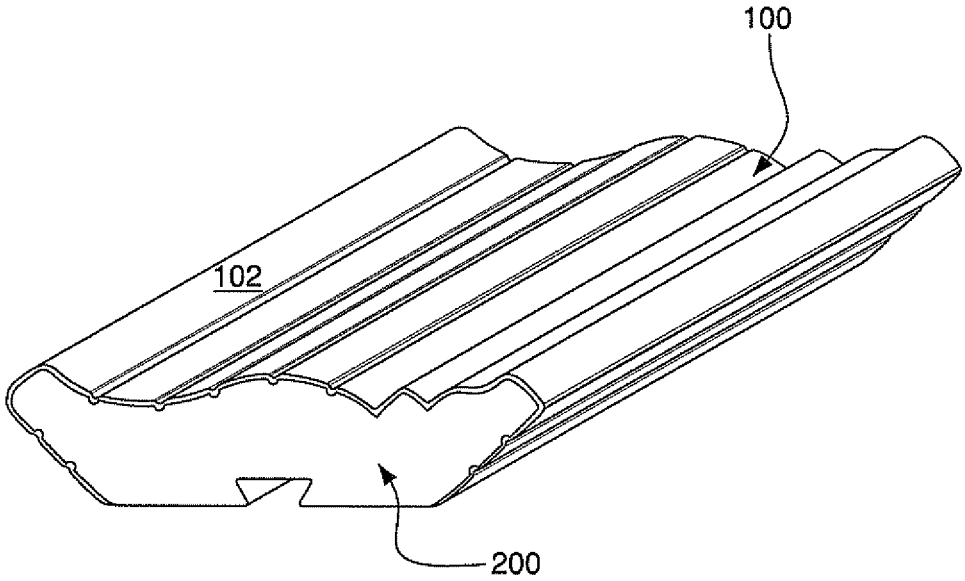
FIG. 1 is a view of a portion of an architectural foam moulding.
Figure 2:
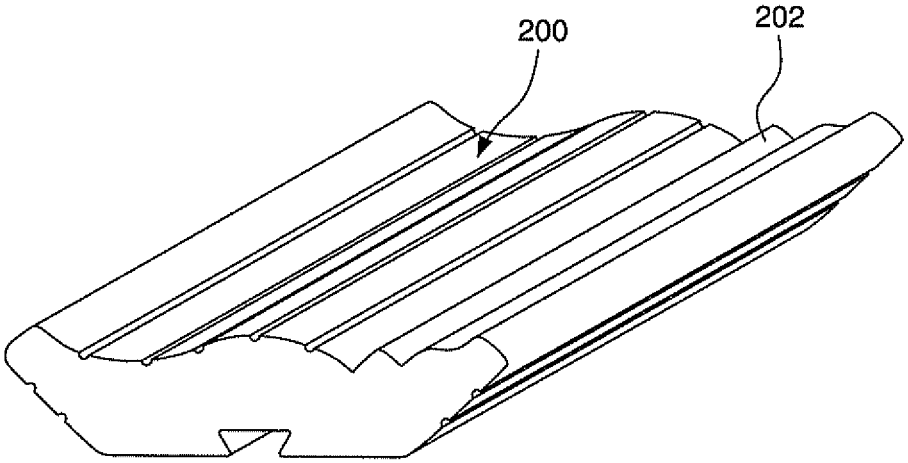
FIG. 2 is a view of a portion of an exemplary foam core of an architectural foam moulding.
Figure 3:
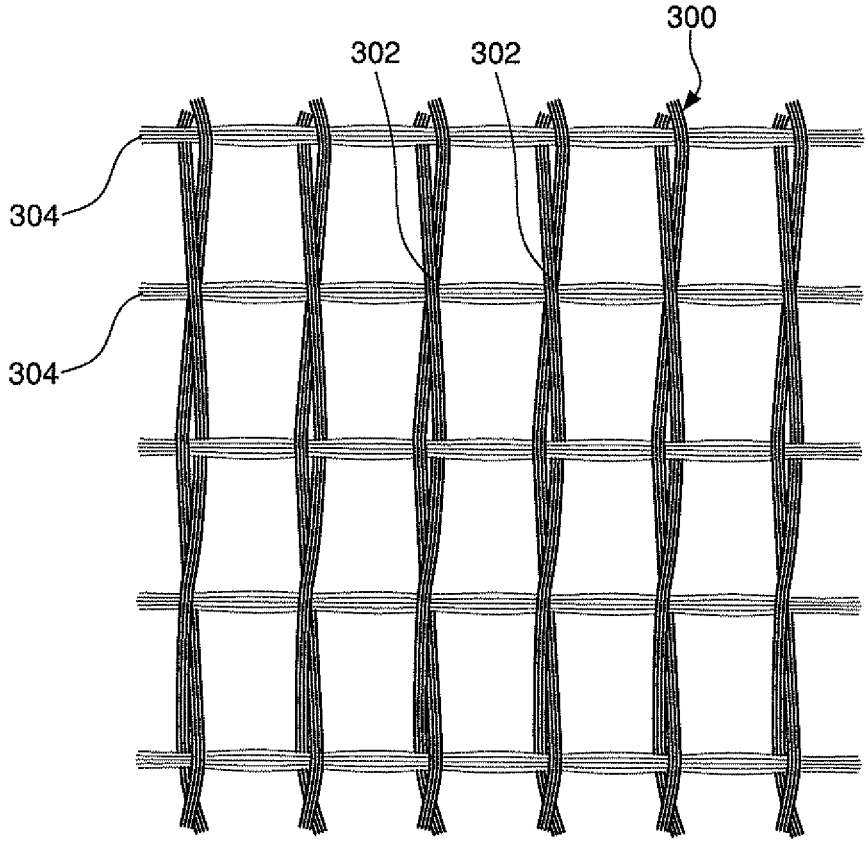
FIG. 3 discloses a portion of a reinforcement mesh for architectural foam mouldings.

FIG. 1 discloses an architectural foam moulding 100 having a cementitious coating 102 imbedding a reinforcement mesh 300, FIG. 3. The cementitious coating 102 adheres to the reinforcement mesh 300 and to a foam core 200, FIG. 2.

FIG. 2 discloses an exemplary polystyrene foam core 200 the surface of which is shaped with decorative, curved architectural features having a curved profile 202 to provide a decorative appearance. The architectural features are exemplary, since different architectural features are created to satisfy a wide range of aesthetic preferences.

FIG. 3 discloses a mesh 300 having warp yarns 302 extending substantially straight in a machine direction. The warp yarns comprise low twist multifilaments of a high tensile strength material, for example, fiber glass. Each of the warp yarns 302 comprises a grouped pair of yarns in a hurl leno weave in the mesh 300. The pairs of warp yarns 302 in the mesh 300 are interlaced with smaller yield (yarn manufacturing yield) sizes of weft yarns 304 extending in a cross machine direction. In an embodiment of the invention, the larger sized warp yarns contribute more than the weft yarns 304 to the areal weight of the mesh 300, such that the mesh 300 comprises a uniwarp mesh 300. A uniwarp mesh 300 has a ratio of warp weight to weft rate that is highly biased toward the areal weight of yarns selected for the warp direction or machine direction. Moreover, larger sized warp yarns compared to the welt yarns are selected for the areal weight of the mesh 300 to comply with an industry standard specification for a minimum areal weight for the mesh 300, for example, 2.5 ounces/yard$^2$(85 g/m$^2$). Prior to the invention, a mesh that met the industry standard specification for minimum areal weight tended to undergo significant strain and shape memory recovery, which lifted the mesh from the surface 202 of the architectural moulding core 200. The warp yarns 302 maintain an orientation substantially straight when interlaced in the mesh 300. Accordingly, the straight warp yarns 302 readily extend substantially straight along the foam core 200 with limited strain incurred and without the strain that would result from having to straighten the warp yarns 302. An embodiment of the invention wherein the warp yarns 302 are stiffer than the weft yarns 304 further enable the warp yarns 302 to remain substantially straight when interlaced in the mesh 300, and further enable the warp yarns 302 to extend substantially straight along the foam core 300.

The weft yarns 304 bend relative to the straight warp yarns 302 in the mesh 300. Each of the weft yarns 304 comprise ribbons, low twist multifilaments or rovings. To manufacture a lower range of low yield sizes, the weft yarns preferably comprise multifilaments. To manufacture an upper range of low yield sizes, the weft yarns preferably comprise rovings. In an embodiment of the invention, the areal weight and thickness sizes of the weft yarns 304 are substantially less than that of the warp yarns 302, such that the weft yarns 304 are relatively more limp, and the warp yarns 302 are relatively more stiff. The weft yarns 304 are smaller in yield sizes than the warp yarns 302, such that the weft yarns 304 are thinner and weaker, and readily bend relative to the warp yarns 302. The weft yarns 304 conform to the curved profile 202 of the foam core 200 with limited amounts of elastic strain incurred, which limits the tendency for shape memory recovery. The elastic strain is substantially relieved when bending the thinner and weaker weft yarns 304. According to embodiments of the invention, the weft yarns 304 are of lower tensile strength material compared to the material of the warp yarns 302. For example, the warp yarns 302 comprise glass, and the weft yarns 304 comprise a more pliable material, such as a natural fiber material, polymer, plastic or other material described herein.

FIG. 3 discloses an embodiment of the invention in which the multifilaments 306 are intertwined to form a corresponding low twist weft yarn 304, and after being interlaced in the mesh 300, tend to spread apart laterally and form a substantially limber and flat ribbon of the multifilaments 306. The flat ribbon and the multifilaments 306 thereof occur in the mesh 300 when pairs of strands 502, 504, FIG. 5, in a corresponding weft yarn 304 are in a hurl leno weave, wherein the pairs form self crossovers 508 that are limited in number and are spaced apart in the mesh 300. The multifilaments 306 are disposed in the distances between the self crossovers 508, and are free to spread laterally and form substantially flat ribbons of the multifilaments 306. Moreover, the low twist, the absence of high twist, of the corresponding weft yarn 304 enables the multifilaments 306 to spread apart. The multifilaments 306, being thinner and weaker than the weft yarn 304 as a whole, are individually easier to bend than the intertwined multifilaments of the weft yarn 304 as a whole. Thereby, the multifilaments 306 readily bend to conform to and against the curved profile 202 of the foam core 200 while incurring limited elastic strain. The elastic strain is substantially limited by making thinner and weaker multifilaments of a weft yarn 304. The multifilaments 306 themselves are too fragile for weaving individually. By being intertwined in corresponding weft yarns 304 the multifilaments are interlaced in the mesh 300 and spread apart after being interlaced. When the weft yarns 304 comprise rovings, the rovings tend to flatten to form a flat ribbon, since the rovings are limber rather than stiff and are slender as are the multifilaments 306.

After being interlaced, the mesh 300 is coated with a polymeric binder, for example, Acrylic 292, that adheres the yarns together at crossovers in the mesh 300 where the warp yarns 302 cross over the weft yarns 304, and additionally where the pairs of warp yarns 302 cross over each other in the hurl leno weave. In FIG. 3, a pressure sensitive adhesive layer 308 is added as a layer onto one side of the mesh 300. The multifilaments 306 that are present in the mesh 300 are coated with the adhesive layer 308. For example, the adhesive layer is applied by a brush applicator, a roll applicator or a spray applicator. The adhesive is selected for its capability to form an adhesive bond with the foam core 200.

Figure 4:
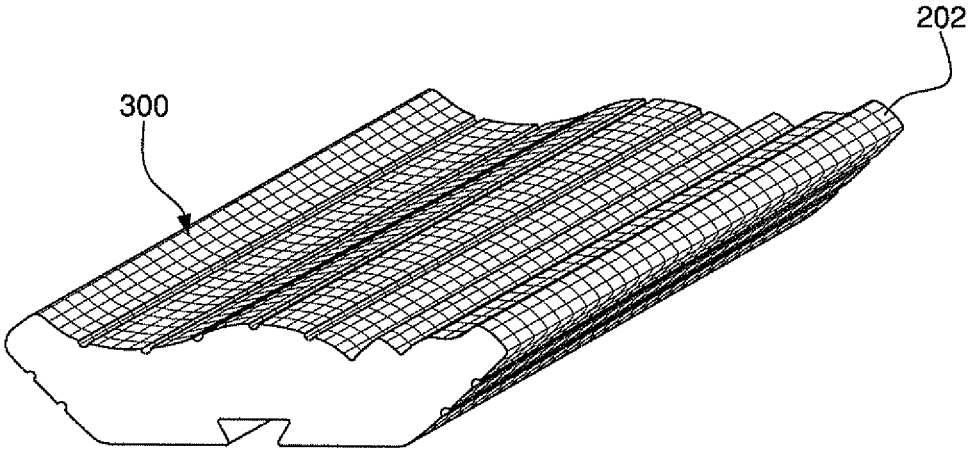
FIG. 4 is a view similar to FIG. 2 with a reinforcement mesh adhered to the profile of decorative, curved architectural features of the foam core.

FIG. 4 discloses the mesh 300 adhered to the curved profile 202 by the adhesive layer 308. The pressure sensitive adhesive is of low tenacious nature while maneuvering the mesh 300 under light pressure against the curved profile 202. The tenacious adhesive nature is increased when the mesh 300 is pressed into place against the curved profile 202. The weft yarns 304 are bent to conform to the curved profile 202, which tends to cause elastic strain in the weft yarns 304. The presence of elastic strain causes a tendency for shape memory recovery of the weft yarns 304, which would apply a spring bias on the adhesive causing the adhesive to give way under tension and release the mesh 300 from adherence to the profile 202. Although a more tenacious adhesive can be used, such an adhesive would adhere immediately on contact and would prevent further maneuvering of the mesh 300 into precise position against the curved surfaces of the foam core. The use of a tenacious adhesive that is slow curing would require clamping pressure for a time period until taking a set, which would delay the manufacturing process. A soft ductile, acrylic adhesive coating is used in an existing 0033 mesh. and in the mesh 300 of the present invention. Moreover, a ductile adhesive has a low elastic strain limit to avoid storing elastic spring energy when bent with the mesh 300. An embodiment of the invention relies upon a combination of the adhesive with a mesh 300 according to various embodiments of the invention.

The 0033 mesh is commercially available from Saint-Gobain Technical Fabrics Canada, Ltd. and has the following construction.

(a.) A leno weave of ASTM D-3775 fiber glass yarns (b.) 25 warp yarns per 10 cm., 20 weft yarns per 10 cm.

(c.) weight of 80 g/m$^2$ by ASTM D-3776

(d.) thickmess of 0.31 mm. by ASTM D-1777, and (e.) minimum tensile strength 350 Newtons per 2.54 cm. by ASTM D-5053.

The lengthwise direction of the moulding 100 is the direction along which bending and undue thermal expansion loads occur. The mesh 300 is always applied to the foam core 200 such that the warp yarns 302, further referred to as, the machine direction yarns, extend and run substantially parallel to the longitudinal axis, or lengthwise, of the moulding 100 and core 200, and are adhered in place by the adhesive. Thereby, the warp yarns 302 are always substantially linear and straight when they are positioned against the profile 202 of respective curved surfaces of the moulding 100. The warp yarns 302 resist the longitudinal beam bending loads and the longitudinal thermal expansion and contraction loads. Since the warp yarns 302 are always substantially straight and longitudinal of the core 200 when they are positioned against the profile 202, they are substantially free of bends. The warp yarns 302 are interlaced substantially straight in the mesh 300 to limit the strain that would result from having to straighten the warp yarns 302. Further, the substantially limited strain of the warp yarns 302 substantially limits the stress transferred to the weft yarns 304. Further, the warp yarns 302 must be substantially free of torque when interlaced in the mesh 300 to limit, and even avoid, undue undulation or bending. Accordingly, a hurl leno weave is selected for the mesh 300, which has a low internal torque component.

The architectural features of the moulding 100 and core 200 comprise one or more curved surfaces that provide the moulding 100 with a decorative appearance. The profile 202 of the curved surfaces is curved with respective radii of curvature transverse to a longitudinal axis, lengthwise, of the moulding 100. For example, the one or more curved surfaces comprise, reversely curved surfaces, outside corners and inside corners, respectively, which are difficult for the mesh 300 to bend and conform thereagainst. The weft yarns 304, extend in the weft direction, or cross-machine direction relative to the warp yarns 302. Moreover, the weft yarns 304 extend in directions transverse to the longitudinal axis of the moulding 100. In the transverse directions the bending loads of the moulding 100 and thermal dimensional loads are substantially less than such loads in the longitudinal direction. The weft yarns 304 are selected, less for resisting high loads, and more for their capability of bending and conforming to and against the curved surfaces of the core 200 of the moulding 100, with substantially limited or reduced elastic strain contributing to a tendency for shape memory recovery of the weft yarns 304. By relieving the elastic strain and relieving the tendency for shape memory recovery, the bent weft yarns 304 remain fixed in place after being bent to conform to and against the curved profile 202 of the curved architectural features.

An exemplary embodiment of a mesh 300 is disclosed by TABLE 1 compared with an existing 0033 fiber glass fabric available from Saint-Gobain Vetrotex.

TABLE 1

MESH CONSTRUCTION COMPARED

| PROPERTY | MESH OF INVENTION | EXISTING 0033 FABRIC MESH |
|---|---|---|
| WEAVE TYPE | Hurl Leno | Full Leno |
| YARN COUNT | | |
| Warp Ends/10 cm. | 19.8 | 25 |
| Weft Picks/10 cm. | 17.7 | 19.8 |
| | WARP YARN | |
| Type | Fiberglass | Fiberglass |
| Tex (gm/km) | 134 × 2 yarns | 66 × 2 yarns |
| Twist | 1.7/inch | N/A |
| | WEFT YARN | |
| Material Type | Polyester | Fiber glass |
| Tex (g/km.) | 56 | 134 |
| Denier (g/9000 m.) | 500 | N/A |
| | Areal Weight (g/m$^2$) | |
| Warp yarns 302 only | 53.1 | 33 |
| Weft yarns 304 only | 9.9 | 26.5 |
| Total Mesh Weight | 63 | 59.5 |
| Adhesive Coated Areal Weight | 87 | 83 |
| Weight Ratio Warp/Weft | 84/16 | 55/45 |
| Coating | | |
| First Pass Weight % | 20 | 22 |
| Type | 292 | 292 |
| Adhesive Weight % | 12 | 12 |
| Type | Acrylic | Acrylic |

FIG. 3 discloses that the warp yarns 304 comprise a reduced number of warp yarns per unit of length, such that the mesh 300 has relatively wide openings per square unit of area. According to one embodiment of the invention, the weft yarns 304 comprise a reduced number or limited number of yarns per unit of length in the mesh 300, or a reduced or limited count, especially compared to a higher count of warp yarns 302. An objective is to limit or reduce the number of weft yarns 304, which when doing the same, provides a uniwarp mesh 300. A uniwarp mesh 300 is highly biased toward the areal weight amount of yarn present in the warp direction or machine direction. When the warp yarns 302 are moved into positions lengthwise against the architectural moulding 100 the warp yarns 302 remain straight and parallel to one another, much as they are interlaced in the mesh 300. Accordingly, the warp yarns 302 undergo limited bending, which produces limited elastic strain which can transfer to the weft yarns 304 to cause a tendency for shape memory recovery.

FIG. 3 discloses exemplary groups of warp yarns 302. For example, six exemplary warp yarns 302 are arranged in two groups of three warp yarns 302 in each group, or are arranged in three groups of two warp yarns 302 in each group. In FIG. 3, the spacing between adjacent warp yarns 302 in the same group compared to the spacing between different groups of warp yarns 302 is either the same spacing or not the same spacing.

FIG. 3 discloses exemplary groups of weft yarns 304. FIG. 3 discloses five exemplary weft yarns 304 arranged in groups of three weft yarns 304, and two weft yarns 304, respectively. In FIG. 3, the spacing between adjacent weft yarns 304 in the same group compared to the spacing between different groups of weft yarns 304 is either the same spacing or not the same spacing.

The weft yarns 304 are moved to bend and conform along the curved profile 202. The greater the complexity of the curved profile 202 the more bends are required in the weft yarns 304, which increases the likelihood that bending produces elastic strain in the weft yarns 304. The weft yarns 304 are not required to exhibit high tensile strength, such that another embodiment of the weft yarns 304 comprises a reduced or limited yield or tex (grams/1000 meters of the yarn) or denier (grams/9000 meters) allowing them to bend with limited elastic strain tending to cause shape memory recovery. The yield of fibers, particularly, polyester, rayon, cotton, nylon or other polyamide yarns is usually expressed in units of denier rather than tex. According to an embodiment of the invention, the weft yarns 304 comprise one or more yarn materials, which are relatively limp or ductile, or both limp and ductile, when bent. Such weft yarns 304 are bent to conform to and against the curved profile 200 without incurring significant elastic strain contributing to a tendency for shape memory recovery of the weft yarns 304. For example, the weft yarns 304 comprise multifilaments, fiber rovings, ribbons or strands including, but not limited to, cellulose, cotton, kapok, sisal, flax, hemp, jute, kenaf, ramie, silk, wool, acetate, azlon, acrylic, nylon, saran, spandex, olefin, polyester, polyethylene, rayon, triacetate, vinal and combinations thereof.

According to another embodiment of the invention, the weft yarns 304 comprise a binder coating of a ductile, low elastic modulus binder material, for example, a polyacrylic, rather than a stiff, high elastic modulus material, such as, styrene butadiene rubber (SBR).

The warp yarns 302 in the woven mesh 300 tend to apply torque to the weft yarns 304. Such torque tends to induce a significant strain on the weft yarns 304 that would contribute to an undesired tendency for shape memory recovery. Accordingly, the mesh 300 comprises a hurl leno weave to minimize the torque applied by the warp yarns 302 to the mesh yarns, and particularly, when the mesh 300 is interlaced with warp yarns 302 of greater areal weight than the weft yarns 304.

Figure 5:
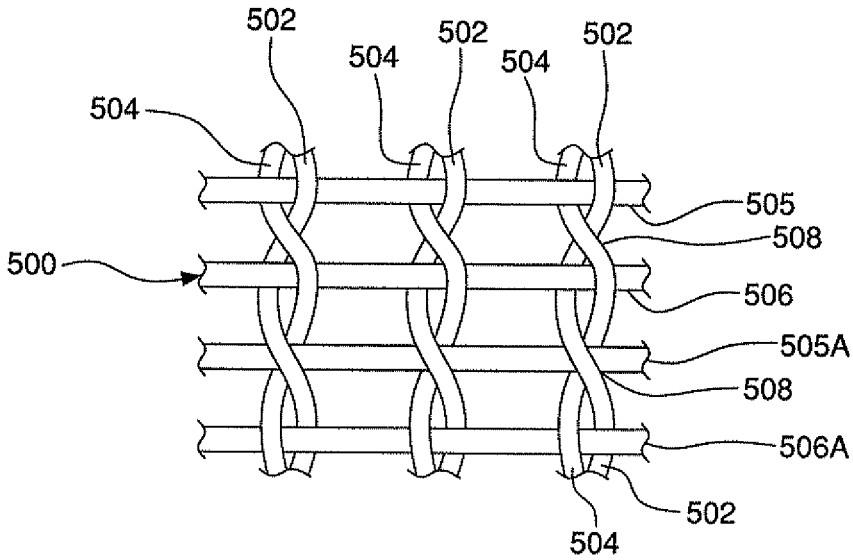
FIG. 5 is a schematic view of a hurl leno weave structure.

FIG. 5 discloses a hurl leno weave 500. In a hurl leno weave, one or more of an individual warp yarn 302 has two warp yarn strands 502, 504 that interlace by crossing over each other to produce a self crossover 508. Further, the two strands of respective warp yarns 302 interlace with successive weft yarns 304 on opposite sides of the weft yarns 304.

The hurl leno weave 500 will now be described. A first warp yarn strand 502 is woven to cross over a first weft yarn 505 while a second warp yarn strand 504 is woven to cross under the first weft yarn 505 and then to cross over the first warp yarn strand 502 to produce a self crossover 508.

Then the first warp yarn strand 502 crosses under a successive or second weft yarn 506 while the second warp yarn strand 504 crosses over the second weft yarn 506, without producing another self crossover like the self crossover 508.

Then the first warp yarn strand 502 crosses over a successive third warp yarn 505*a*, while the second warp yarn strand 504 crosses under the third warp yarn 505*a* and under the first warp yarn strand 502 that has crossed over the third warp yarn 505*a*. Another self crossover 508 is produced wherein the warp yarn strands 502, 504 cross over each other Then the first warp yarn strand 502 crossed under a successive fourth warp yarn 506*a*, while the second warp strand 504 crosses over the fourth warp yarn 506*a* without crossing over the first warp yarn strand 502 that has crossed under the fourth warp yarn 506*a*. No self crossover is produced like the self crossover 508. The weave is repeated to interlace the two warp yarn strands 502, 504 with successive weft yarns to produce self crossovers 508 that are less in number than the number of successive weft yarns, such as, the self crossover 508 and the successive weft yarns 505, 506, 505*a*, 506*a*. The number of self crossovers 508 is less than the number of successive weft yarns 304, FIG. 3, such that torque induced strain due to the self crossovers is minimized.

According to embodiments of the invention, the reinforcement mesh 300 or 500 includes successive weft yarns 505, 506, 505*a*, 506*a*, which are consecutive and adjacent or which include additional weft yarns, respectively, between successive weft yarns 505, 506, 505*a*, 506*a*. Although the exemplary hurl leno weave 500 is disclosed in FIG. 5, wherein the successive weft yarns 505, 506, 505*a*, 506*a*, are consecutive and adjacent, the successive weft yarns 505, 506, 505*a*, 506*a*, may be accompanied by additional weft yarns therebetween, such that the warp yarn strands 502, 504 extend across additional weft yarns, respectively, between the successive weft yarns 505 and 506, between the successive weft yarns 506 and 505*a*, and between successive weft yarns 505*a* and 506*a*, while the warp yarn strands are interlaced solely with the successive weft yarns 505, 506, 505*a*, 506*a*, and not with the additional weft yarns therebetween. Thereby, the number of self crossovers 508 per unit length of the mesh is limited further by spacing apart the successive weft yarns 505, 506, 505*a*, 506*a* and/or excluding additional weft yarns from being interlaced between two strands 502, 504 of a warp yarn.

In FIG. 5, the self crossovers 508 of the two warp yarn strands 502, 504 are limited to occur at every odd numbered successive weft yarns 505, 505*a*, while self crossovers are eliminated at every even numbered successive weft yarns 506, 506*a*, in the mesh. When the mesh is turned back to front and the back side is observed, the same pattern of self crossovers are present. By eliminating self crossovers of the weft yarn strands 502, 504 at even numbered weft yarns 506, 506*a*, the torque that would result and be applied to the mesh by the reduced or limited number of self crossovers is substantially minimized or limited. The weft yarns 505, 506, 505*a*, 506*a*, while being subject to the substantially limited torque applied by the warp yarns 502, FIG. 5 or 302, FIG. 3, nonetheless are free of significant torque induced strain, of such significance, that would contribute to an undesired tendency for shape memory recovery. The number of self crossovers is further reduced or limited by decreasing or limiting the count of the weft yarns 505, 506, 505*a*, 506*a*, to limit the number of weft yarns per unit length of the mesh. In TABLE 1, a limited, lower warp yarn count is present in an embodiment of the invention compared to an existing 0033 fabric (19.8 yarn count versus 25 Warp Ends/10 cm.).

FIG. 3 discloses the mesh 300 having a hurl leno weave. The warp yarns 302 in the mesh 300 are required to move into positions straight and lengthwise against the core 200 of the moulding 100. Each self crossover of the warp yarns 302 must be displaced into positions straight and lengthwise against the core 200 without inducing significant strain on the weft yarns 304, of such significance, that would contribute to an undesired tendency for shape memory recovery. In the hurl leno weave, the number of self crossovers of the warp yarns 302 per unit length is reduced or limited by reducing or limiting the count of the weft yarns 304 that amounts to increasing the spacing between the weft yarns 304. Thereby, the self crossovers that must be moved into positions straight and lengthwise against the moulding are reduced or limited in number. A reduced or limited number of self crossovers are capable of being moved into positions against the moulding without inducing significant strain of the weft yarns 304.

Further, according to TABLE 1, the mesh 300 is interlaced with warp yarns 302 of greater areal weight than the weft yarns 304 (134 tex, two warp yarns 302 of fiber glass versus 56 tex or 500 denier, one weft yarn of polyester). A greater mass and surface area of glass yarns in the warp direction means that a higher volume of adhesive is carried by the glass yarns, which increases the adhesion or adherence of the mesh 300 to the moulding, and counteracts a tendency for the weft yarns 304 for shape memory recovery. The glass yarns in the warp direction increases the strength of the mesh 300, such that the mesh 300 is rolled up on itself into a roll, and is unwound without tearing either the warp yarns 302 or the weft yarns 304. The breaking strength of the mesh 300 actually increased by 61% compared to the existing 0033 fabric, which corresponds to the 61% increase in the weight of warp yarns 302 in the warp direction. The areal weight of the mesh 300 is 87 g/m$^2$. The industry has adopted a standard for a mesh areal weight at 2.5 ounces/yard$^2$ (85 g/m$^2$). However, the invention is not limited to a specific mesh areal weight. There is an opportunity to reduce or limit the areal weight and cost of the individual warp yarns 302, and of the mesh 300, to comply with a lower amount of resistance to bending by a specific architectural feature. The warp is in the direction in which reinforcement to resist bending is needed by the moulding. The strength gain or reduction in the warp direction can be adjusted by a corresponding adjustment in either the areal weight or the tex of the warp yarns 302 to correspond with an amount of resistance to bending required by a specific architectural feature of a moulding. Thus, an embodiment of the invention involves limiting or reducing the tex of the warp yarns 302 to comply with a lower amount of resistance to bending corresponding to specific architectural features of the moulding 200.

There is an opportunity to reduce or limit the areal weight and cost of the individual weft yarns 304, and of the mesh 300, by one or more of; using polyester or other polymeric warp yarns 302 in place of fiber glass or other stiff warp yarns 302, reducing or limiting the count of the weft yarns 304 (yarns/10 cm. unit length) and reducing or limiting the yield or tex or denier of the weft yarns 304. In TABLE 1, a mesh 300 has polyester weft yarns 304 compared to fiber glass in the existing 0033 fabric. Polyester has a tensile elastic modulus that is 30 times lower than that of glass. Thus, polyester is more ductile, more limp and bends easier with less resistance to bending than does glass. The present invention includes, but is not limited to polyester warp yarns 302. Further, the mesh 300 has a slightly lower count in the weft direction compared to an existing 0033 fabric (17.7/10 cm. versus 19.8/10 cm.). The weft yarn count can be reduced or limited further when the ariel weight of the completed mesh 300 is permitted to fall below the industry accepted standard at 2.5 oz/yd$^2$ (85 g/m$^2$).

This description of the exemplary embodiments is intended to be read in connection with the accompanying drawings, which are to be considered part of the entire written description. In the description, relative terms such as "lower," "upper," "horizontal," "vertical, " "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A reinforcement mesh to bend and conform to and against a curved profile of curved architectural features on a longitudinally straight architectural moulding, comprising:

bendable polymeric weft yarns in the reinforcement mesh joined with a pair of substantially straight fiberglass warp yarns in a hurl leno weave, wherein each individual fiberglass warp yarn in the pair have a higher tensile modulus than the polymeric weft yams of a second material substantially stiffer than the first material, an adhesive on the reinforcement mesh to adhere the reinforcement mesh to directly contact the curved profile having reversely curved surfaces, outside corners and inside corners, respectively, wherein the bendable polymeric weft yarns are smaller in yield sizes than each individual fiberglass warp yarn in the pair of fiberglass warp yarns, such that the polymeric weft yams are thinner and weaker, and readily bend relative to the fiberglass warp yams, wherein the adhesive is a soft ductile adhesive, and the fiberglass warp yarns and the polymeric weft yams are coated with a ductile, low elastic modulus binder material, for the polymeric weft yams to be bendable relative to the substantially straight warp yams with limited elastic strain and wherein the bendable polymeric weft yams and the binder material are bendable to have reversely curved surfaces, outside corners and inside corners, respectively, against the curved profile, and are bendable relative to the substantially straight fiberglass warp yams with limited elastic strain to prevent release of the adhesive from direct contact from the curved profile while the substantially straight fiberglass warp yarns extend substantially straight against the longitudinally straight architectural molding.

2. The reinforcement mesh of claim 1 wherein the polymeric weft yarns comprise polyester, acetate, acrylic, nylon, olefin, polyethylene, rayon, triacetate, polyamide, or combination thereof.

3. The reinforcement mesh of claim 1 wherein the soft ductile adhesive comprises an acrylic adhesive, and the ductile, low elastic modulus binder material comprises a polyacrylic material.

4. The reinforcement mesh of claim 1, wherein the areal weight of the warp yarns is larger than that of the weft yarns to comply with an industry standard specification of 2.5 ounces/yard$^2$ (85 g/m$^2$) for a minimum areal weight for the mesh.

5. The reinforcement mesh of claim 1, wherein the warp yarns remain substantially straight.

6. The reinforcement mesh of claim 1, wherein strands of a corresponding warp yarn cross over each other to provide self crossovers, and the self crossovers comprise less in number than the weft yarns to limit torque induced strain due to the self crossovers.

7. The reinforcement mesh of claim 6, wherein the adhesive is pressure sensitive to adhere the mesh against the curved profile.

8. The reinforcement mesh of claim 6, wherein the warp yarns have an areal weight larger than that of the weft yarns such that the mesh complies with an industry standard specification of 2.5 ounces/yard$^2$ (85 g/m$^2$) for a minimum areal weight for the mesh.

9. The reinforcement mesh of claim 6, wherein the self crossovers comprise half in number compared to the weft yarns in number.

10. The reinforcement mesh of claim 1, wherein strands of a corresponding warp yarn cross over each other to provide self crossovers, and the self crossovers comprise less in number than the weft yarns to limit torque induced strain due to the self crossovers.

11. The reinforcement mesh of claim 10, wherein the weft yarns bend with limited elastic strain incurred by limiting a size of each of the weft yarns.

12. The reinforcement mesh of claim 10, wherein each of the weft yarns comprises multifilaments that spread apart in the mesh.

13. The reinforcement mesh of claim 1, wherein strands of a corresponding warp yarn cross over each other to provide self crossovers, and the self crossovers are less in number than successive weft yarns to limit torque induced strain due to the self crossovers, and the strands of a corresponding warp yarn comprise multifilaments that spread apart in the mesh.

14. A longitudinally straight architectural moulding, comprising:

a core having reversely curved surfaces, outside corners and inside corners, respectively, on a surface thereof;

a reinforcement mesh to bend and conform to and against the surface of said core; bendable polymeric weft yarns in the reinforcement mesh joined with a pair of substantially straight fiberglass warp yarns in a hurl leno weave, wherein each individual warp yarn in the pair have a higher tensile modulus than the polymeric weft yarns, an adhesive on the reinforcement mesh to adhere the reinforcement mesh to directly contact the reversely curved surfaces, outside corners and inside corners, respectively, wherein the bendable polymeric weft yarns are smaller in yield sizes than each individual fiberglass warp yarn in the pair of fiberglass warp yarns, such that the polymeric weft yarns are thinner and weaker, and readily bend relative to the fiberglass warp yarns, wherein the adhesive is a soft ductile adhesive, and the fiberglass warp yarns and the polymeric weft yarns are coated with a ductile, low elastic modulus binder material for the polymeric weft yarns to be bendable relative to the substantially straight fiberglass warp yarns with limited elastic strain and wherein the bendable polymeric weft yarns and the binder material are bendable against the surface of said core, and are bendable relative to the substantially straight fiberglass warp yarns with limited elastic strain to prevent release of the adhesive from direct contact from the curved profile while the substantially straight fiberglass warp yarns extend substantially straight against the longitudinally straight architectural molding; and a cementitious coating covering the mesh.

15. The architectural moulding of claim 14 wherein the the polymeric weft yarns comprise polyester, acetate, acrylic, nylon, olefin, polyethylene, rayon, triacetate, polyamide, or combination thereof.

16. The architectural moulding of claim 14 wherein strands of a corresponding warp yarn cross over weft yarns and cross over each other to provide self crossovers, and the self crossovers are less in number than the weft yarns.

17. The architectural moulding of claim 16, wherein the soft ductile adhesive comprises an acrylic adhesive, and the ductile, low elastic modulus binder material comprises a polyacrylic material.

18. The architectural moulding of claim 16, wherein the self crossovers are less in number than the weft yarns in number to limit the resistance to bending of the weft yarns.

19. The architectural moulding of claim 14, wherein the weft yarns comprise a yield strength less than that of the warp yarns for the weft yarns to bend with limited elastic strain incurred.

20. The architectural moulding of claim 14, wherein each of the weft yarns comprises multifilaments that spread apart in the mesh.

21. The architectural moulding of claim 14, wherein each of the warp yarns comprise multifilaments that spread apart in the mesh.

22. The architectural moulding of claim 21, wherein strands of a corresponding warp yarn cross over each other to provide self crossovers, and the self crossovers comprise less in number than the weft yarns in number to limit torque induced strain due to the self crossovers, and the strands of a corresponding warp yarn comprise the multifilaments that spread apart in the mesh.

23. A reinforcement mesh to bend and conform to and against a curved profile of curved architectural features on a longitudinally straight architectural moulding, comprising:

bendable polyester weft yarns in the reinforcement mesh joined with substantially straight fiberglass warp yarns in a hurl leno weave, the fiberglass warp yarns having a higher tensile modulus than the polyester weft yarns, an adhesive on the reinforcement mesh to adhere the reinforcement mesh to directly contact the curved profile having reversely curved surfaces, outside corners and inside corners, respectively, wherein the bendable polyester weft yarns are smaller in yield sizes than the fiberglass warp yarns, such that the polyester weft yarns are thinner and weaker, and readily bend relative to the fiberglass warp yarns, wherein the adhesive is a soft ductile adhesive, and the fiberglass warp yarns and the polyester weft yarns are coated with a ductile, low elastic modulus binder material, for the polyester weft yarns to be bendable relative to the substantially straight warp yarns with limited elastic strain, and wherein the bendable polyester weft yarns and the binder material are bendable to have reversely curved surfaces, outside corners and inside corners, respectively, against the curved profile, and are bendable relative to the substantially straight fiberglass warp yarns with limited elastic strain to prevent release of the adhesive from direct contact from the curved profile while the substantially straight fiberglass warp yarns extend substantially straight against the longitudinally straight architectural molding.

* * * * *